United States Patent [19]

Iino

[11] 3,981,741

[45] Sept. 21, 1976

[54] FIBROUS CLEANING MATERIALS IMPREGNATED WITH A LATEX-MIXTURE

[76] Inventor: Hirokazu Iino, 4/40, Kasumi-cho, Nishinomiya, Hyogo, Japan

[22] Filed: Mar. 3, 1975

[21] Appl. No.: 555,046

Related U.S. Application Data

[62] Division of Ser. No. 416,510, Nov. 16, 1973, abandoned.

[30] Foreign Application Priority Data

Nov. 16, 1972 Japan ..... 47-115082

[52] U.S. Cl. ..... 134/6; 15/209 R

[51] Int. Cl.[2] ..... B08B 7/00; A47L 1/08; A47L 13/16

[58] Field of Search ..... 134/6; 15/209 R, 256.6

[56] References Cited

UNITED STATES PATENTS

| | | | |
|---|---|---|---|
| 2,784,132 | 3/1957 | Maisel | 15/209 R X |
| 2,958,593 | 11/1960 | Hoover et al. | 15/209 R X |
| 3,208,093 | 9/1965 | Hansen | 15/209 R X |

*Primary Examiner*—Norman Yudkoff
*Assistant Examiner*—Dale Lovercheck
*Attorney, Agent, or Firm*—Armstrong, Nikaido & Wegner

[57] ABSTRACT

A method for cleaning a soiled surface comprising rubbing the surface in the presence of water with a fibrous cleaning material characterized in that a fibrous carrier is impregnated with a rubber latex of at least one member selected from the group consisting of natural rubber, butadiene rubber and styrene-butadiene rubber and a high molecular weight substance selected from the group consisting of polyvinyl acetate, vinyl acetate-ethylene copolymer, acrylonitrile-butadiene copolymer, polychloroprene and acrylic resin and thereafter drying.

8 Claims, No Drawings

FIBROUS CLEANING MATERIALS IMPREGNATED WITH A LATEX-MIXTURE

This is a division, of application Ser. No. 416,510, filed Nov. 16, 1973 and now abandoned.

This invention relates to a fibrous cleaning material, more particularly to a fibrous material for cleaning soiled surfaces.

Conventionally known as fibrous cleaning materials are, for example, (1) absorbent cotton impregnated with an aqueous solution of disinfectant such as chlorhexidinegluconate and enclosed with aluminum foil and/or a film of polyethylene or like synthetic resin, (2) cotton cloth, synthetic fiber cloth, etc. having adsorbed thereon spindle oil or like mineral oil as emulsified with a surface active agent, followed by dewatering and drying, (3) fiber cloth impregnated with an aqueous solution of nonionic active agent of the polyoxyethylene nonylphenol ether type and polyvinyl alcohol, dewatered and dried, and (4) absorbent cotton, cotton cloth, etc. impregnated with an aqueous solution of surface active agent and enclosed with aluminum foil and/or synthetic resin film.

However, these fibrous cleaning materials have various drawbacks. The cleaning material (1) is intended to disinfect the hand for example when taking meals and is therefore as low as wet cloth or paper in its cleaning ability to remove greasy or oily dirt. The cleaning material (2) chiefly aims to adsorb dust off the surfaces of floor, furniture, machines, etc. and to render the surfaces glossy but is not significantly effective in degreasing and may possibly leave a nasty smell of oil on the surface cleaned. Accordingly, it is not usable to clean hand, tableware, kitchen utensils, etc., and therefore finds limited applications. The cleaning material (3) is contemplated as a substitute for waste cloths of vegetable and animal fibers heretofore used in industry but is not noticeably effective in removing stubborn greasy or oily dirt. Further although the cleaning material (4) is convenient to carry around, it comprises a fiber material which is employed merely as a carrier for the surface active agent and is therefore almost ineffective in removing stubborn dirt as of oil and grease.

It is, therefore, a main object of the present invention to eliminate the above drawbacks of the conventional fibrous cleaning material.

Another object of the present invention is to provide a fibrous cleaning material which can remove even obstinate greasy dirt from the surface to be cleaned.

A further object of the present invention is to provide a fibrous cleaning material which can be applied to various surfaces to be cleaned without leaving a nasty smell thereon.

These and other objects of the present invention will be apparent from the description to follow.

The present invention provides a fibrous cleaning material characterized in that a fibrous carrier is impregnated with at least one species selected from the group consisting of natural rubber latex, butadiene rubber latex and styrene-butadiene rubber latex and is thereafter dried to cause the carrier to retain the rubber.

The researches of the present inventor have unexpectedly revealed that in the case where a fibrous material is impregnated with at least one of natural rubber, butadiene rubber and styrene-butadiene rubber latexes, then dried and thereafter wetted with water again, the resulting material can adsorb and remove various stains, dirts and disagreeable smells very effectively. In fact, it has been found that obstinate greasy or oily dirt and smells of fish, garlic and the like which are not removable by usual cleaning method can be removed completely with only one to several strokes of the wet material in rubbing contact with the surface to be cleaned. Such peculiar property of rubber becomes available only when fibrous material is impregnated with the rubber latex and then dried, while when rubber latex is directly applied to a surface to be cleaned and then rubbed, such effect can not be attained because the latex gets tacky by virtue of absorption of greasy dirt and becomes difficult to remove therefrom. By the same reason the fibrous material impregnated with rubber latex but not dried can not display any cleaning effect. Similarly, rubber latex as merely dried without application to fibrous material is least suggestive of such unique property of rubber, inasmuch as the dried latex does not have any appreciable ability to absorb oil or grease. Based on the foregoing novel finding, the inventor has accomplished this invention, which will be described below in detail.

Generally, when applied in the form of aqueous emulsion to the surface of an article singly, rubber adheres to the surface strongly and becomes difficult to remove therefrom even by rubbing. Further if oil or grease exists on the applied surface, the rubber will adhere more firmly to the surface. In technical common sense, therefore, it is by no means conceivable that the rubber be serviceable as a principal component of cleaning material which must be readily removable from the applied surface.

However, the inventor has found that when a rubber latex impregnating a fibrous material is dried and thereafter applied to the surface of article in combination with water, the rubber displays a very excellent ability to adsorb dirt on the surface and can easily be separated from the surface with the dirt adsorbed thereon. Thus the fibrous cleaning material of this invention adsorbs dirt very quickly and removes even greasy dirt easily. More specifically, when the surface of article is rubbed by the present cleaning material previously wetted with water, the cleaning material adsorbs not only usual dirt such as dust but also oil, grease, dirt in the form of fine particles such as finely divided carbon black, substances which emit unpleasant smells of fish, garlic, etc., which could not easily be removed with conventional fibrous cleaning agents. After the adsorption of the dirt, the material can readily be removed from the applied surface without adhering thereto. Thus the dirt and the substances emitting unpleasant smells on the surface can be removed completely to render the surface beautiful and odorless very readily and quickly.

It is not clarified as yet why the present cleaning material displays such peculiar properties as above.

The rubber used in the present invention is at least one species selected from the group consisting of natural rubber, polybutadiene rubber and styrenebutadiene rubber. Of these rubbers, most preferable are natural rubber and styrene-butadiene rubber.

The fibrous carriers to be impregnated with rubber latex according to this invention are firbous materials of (1) natural fibers including (a) vegetable fibers such as cotton, hemp, etc. and (b) animal fibers such a such as wool, silk, etc.; and (2) chemical fibers including (a) regenerated fibers such as viscose rayon, cellulose ester fiber, etc., (b) semi-synthesized fibers such as acetate fiber and (c) synthetic sibers such as polyamide, polyvinyl alcohol, polyvinyl chloride, polyester, polyacrylonitrile fibers, etc. Amont these fibers, cotton, acetate fiber, polyamide and polyvinyl chloride are advantageous to use. These carriers may be used in the form of any of nonwoven fabric, wad of fibers, woven fabric, knitted fabric, paper and the like. To impart to the carrier a greater ability to adsorb rubber latex when making the cleaning material and to thereby enhance the ability of cleaning material to adsorb dirt for cleaning operation, the carrier may advantageously be nonwoven fabric, wad of fibers or paper which has a large surface area per unit weight.

The firbous carrier impregnated with rubber latex is dried to cause the carrier to retain the rubber. The amount of the rubber contained in the dried carrier varies greatly with the use of the resulting cleaning material, the kind and properties of rubber itself, type and form of the carrier. Generally, the amount is about 10 to 150 wt.%, preferably 15 to 100 wt.%, based on the weight of the carrier.

Further according to the researches of the inventor, it has been found that the present cleaning material can be improved by incorporating therein a polar high molecular weight substance. The resultant improved cleaning material is very effective in removing very stubborn stains caused by polar hydrocarbons, for example, in removing dimer acid such as a dimer of oleic acid or like unsaturated fatty acid (e.g. "Versadyme", trade mark, product of Daiichi General Co., Ltd., Japan) which is used as a rust inhibitor and lubricant, unsaturated polyesters used ad adhesives and molding materials, and various coating compositions. The polar high molecular weight substances to be used are, for example, polyvinyl acetate, vinyl acetate-ethylene copolymer, acrylonitrile-butadiene copolymer, polychloroprene and acrylic resin.

Of these polar high molecular weight substances, preferable are polyvinyl acetate and vinyl acetate-ethylene copolymer containing at least 80 wt.% of vinyl acetate. Preferable polyvinyl acetate and vinyl acetate-ethylene copolymer used in the present invention have an average polymerization degree of 400 to 5,000, preferably 500 to 1,500. The polar high molecular weight substance dispersed in the mixture with the rubber latex preferably has an average particle size of 0.05 to 2 $\mu$, particularly 0.1 to 0.5 $\mu$. The polar high molecular weight substances can be used alone or in admixture with one another.

In preparation of the improved cleaning material the polar high molecular weight substance is mixed with a rubber latex. The polar high molecular weight substance is preferably employed in the form of aqueous emulsion or latex to make the mixing with rubber latex easy. The amount of polar high molecular weight substance to be mixed is up to 70 wt.%, based on the total weight of the solids in the mixture. If the amount exceeds 70 wt.%, the cleaning material can not exhibit a sufficient dirt removing effect. Preferably, the amount of the high molecular weight substance in the latex mixture is 30 to 60 wt.% of the latter. The particles of the polar high molecular weight substance and those of rubber latex are dispersed in the latex mixture in random fashion. When fibrous material used as a carrier is impregnated with such latex mixture and then dried, the particles of the rubber and those of the polar high molecular weight substance presumably prevent each other from forming films, with the result that the particles adhere to the fibrous material individually to give an enhanced dirt adsorbing ability. However, if the amount of polar high molecular weight substance is less than 30 wt.%, the cleaning material obtained will be somewhat less effective on a stubborn stain as caused by dimer acid. Furthermore, the polar high molecular weight substance has been found effective in reducing the increase in tackiness due to adsorption of greasy dirt, as compared with use of rubber latex alone, this permitting cleaning operation with greater ease.

According to this invention, the following substances may be added to the rubber latex or the latex mixture of rubber and polar high molecular weight substance, depending on the particular application. Alternatively, the fibrous carrier may be impregnated with such substances before or after impregnation with the rubber latex or the above-mentioned latex mixture.

A. Surface active agents of the anionic type such as alkylallyl sulfonate or of the nonionic type such as polyoxyethylene alkyl ether, sorbitan alkyl ester for preventing cohesion of particles in the latex when drying the latex applied to the carrier to afford the largest possible surface area and to thereby assure an improved dirt removing effect. Among the surface active agents, it is preferably to use a surface active agent such as polyoxyethylene sorbitan alkyl ester type. The use of surface active agent increases the effect of removing dirt, especially greasy dirt, from the surface to be cleaned and serves to stabilize the latex when the carrier is impregnated therewith or during the preparation of the latex mixture before impregnation.

B. Wetting agents such as polyethylene oxide, polyvinyl alcohol, carboxymethyl cellulose, sodium alginate, sodium polyacrylate, etc. for satisfactorily wetting the cleaning material in practical use and to thereby permit the cleaning material to exhibit a cleaning effect promptly.

C. Water-soluble and non-volatile solvents for oily dirt such as polyethylene glycol, glycerin and like polyhydric alcohols and the derivatives thereof, dimethyl sulfoxide, etc. which do not dissolve rubber and polar high molecular weight substances but which act to render dirt readily removable from the surface to be cleaned to assure an improved cleaning effect.

D. Silicone oil emulsion which may be added to the rubber latex or latex mixture to prevent a cleaned surface from soiling again.

The fibrous cleaning material of this invention is prepared, for example, in the following manner. A fibrous carrier is impregnated with a rubber latex or a latex mixture of rubber and polar high molecular weight substance by conventional methods, for example, by dipping roller coating or spraying. The concentration of latex can be widely varied depending on the amenability of latex to the particular method of impregnation employed, the viscosity of latex, etc. The amount of latex applied to the fibrous carrier by impregnation is such that when dried the carrier will support about 10 to 150 wt.%, preferably about 15 to 100 wt.%, of solids, i.e. rubber or a mixture of rubber and polar high molecular weight substance, based on the weight of the carrier. Subsequently, the impregnated carrier is dried in the atmosphere or with air at room temperature to about 120°C, whereby the fibrous cleaning material of this invention will be obtained.

To use the cleaning material of this invention, the skin of a person, or the surface of metal, glass, wood, porcelain or the like to be cleaned is rubbed in the presence of water by the present cleaning material with one to several strokes. The cleaning material is wetted or the surface to be cleaned is previously rendered wet, and the surface is directly rubbed by the cleaning material. In this way, oil, grease, fat, dust, dirt, greasy stain, carbon black or like fine powder, smells of oil, garlic or fish, etc. which are not easily removable by usual means can be removed readily and quickly.

The features of this invention will become more apparent from the following examples, wherein percentage and parts are all by weight.

EXAMPLE 1

As listed in Table 1 below, fibrous materials were dipped in a rubber latex or latex mixture, squeezed and dried in the atmosphere to obtain samples of cleaning materials according to this invention.

Table 1

| Sample No. | Fibrous material | Rubber latex or latex mixture | Amount of rubber[3] in dried cleaning material |
|---|---|---|---|
| 1 – 1 | Gauze 30 cm × 30 cm (3 g) | Natural rubber latex[1] (original concn. 60%, used as diluted to 50%) | 2.7 g |
| 1 – 2 | Cotton wad 1.7 cm × 9 cm (3 g) | " | 3.0 g |
| 1 – 3 | Gauze 30 cm × 30 cm (3 g) | 4 parts of 60% natural rubber latex[1] + 6 parts of 40% acrylonitrile-butadiene copolymer latex[2] | 2.7 g |
| 1 – 4 | Cotton wad 27 cm × 7.5 cm (3 g) | " | 3.0 g |

[1]Natural rubber latex, "Dunlop", trade mark, product of Dunlop Co., Great Britain, obtained by centrifuging.
[2]"Hycar 1561", trade mark, product of Nippon Geon Co., Ltd., Japan.
[3]"Amount of rubber" means the amount of rubber of the total amount of rubber and polar high molecular weight substance, as hereinafter.

Next, rouge, stencil ink and oil color were applied to the back of the hand, each over an area of 1 cm by 3 cm. The stained areas thus prepared were then wiped six times longitudinally thereof with each of the four samples of the cleaning materials wetted with water to evaluate cleaning effect by the unaided eye, with the following results:

Sample 1 – 1: The rouge and stencil ink were removed almost completely, leaving barely detectable traces respectively. The oil color was found somewhat less removable, with some stains left unremoved, which however were completely wiped off with several further strokes of rubbing.

Sample 1 – 2: The rouge, stencil ink and oil color were all removed completely without any trace.

Sample 1 – 3: Only a trace of rouge was found detectable, while all the other stains were completely removed. The sample was found especially effective on stencil ink, which was removed by three strokes of rubbing with extreme ease.

Sample 1 – 4: The rouge, stencil ink and oil color were all removed completely, virtually with higher effectiveness than Sample 1 – 3.

Incidentally, natural rubber latex and latex mixture were dried to films without applying them to fibrous material. The films had no ability to remove stains, whether dry or wet.

EXAMPLE 2

Fibrous materials were dipped in rubber latexes as listed in Table 2 below, then squeezed and dried in the atmosphere to prepare samples of cleaning materials according to this invention.

Table 2

| Sample No. | Fibrous material | Rubber latex | Amount of rubber in dried cleaning material |
|---|---|---|---|
| 2 – 1 | Gauze 30 cm × 30 cm (3 g) | Styrene-butadiene rubber latex[1] | 2.7 g |
| 2 – 2 | Cotton wad 17 cm × 9 cm (3 g) | " | 3.0 g |
| 2 – 3 | Gauze 30 cm × 30 cm (3 g) | Butadiene rubber latex[2] | 2.7 g |
| 2 – 4 | Cotton wad 17 cm × 9 cm (3 g) | " | 3.0 g |

Note:
[1]"Nipol 4850", trade mark, product of Nippon Geon Co., Ltd., Japan, having original concentration of 63%, herein used as diluted to 50%.
[2]"JSR 0700", trade mark, product of Japan Synthetic Rubber Co., Ltd., Japan, having original concentration of 59%, herein used as diluted to 50%.

In the same manner as in Example 1, the four cleaning material samples were tested for cleaning ability and were found very effective in removing the stains. Among these samples, Samples 2 – 2 and 2 – 4 made of cotton wads wiped off the stains with only two strokes of rubbing.

EXAMPLE 3

Cotton wads were dipped in latex mixtures respectively as listed in Table 3, then squeezed and dried in the atmosphere to prepare samples of cleaning materials according to this invention.

Table 3

| Sample No. | Fibrous material | Latex mixture | Amount of rubber in dried cleaning material |
|---|---|---|---|
| 3 – 1 | Cotton wad 17 cm × 9 cm (3 g) | 5 parts of 50% butadiene rubber latex[1] + 5 parts of 50% polyvinyl acetate latex[2] | 3 g |
| 3 – 2 | " | 5 parts of 50% natural rubber | 3 g |

Table 3-continued

| Sample No. | Fibrous material | Latex mixture | Amount of rubber in dried cleaning material |
|---|---|---|---|
| | | latex[3] + 5 parts of 50% vinyl acetate-ethylene copolymer latex[4] | |
| 3 – 3 | " | 5 parts of 50% styrene-butadiene rubber latex[5] + 5 parts of 45% acrylic resin latex[5] | 3 g |
| 3 – 4 | " | 6 parts of 40% styrene-butadiene rubber latex[7] + 4 parts of 60% polychloroprene latex[8] | 3 g |

Note:
[1]Same as Sample 2 – 2.
[2]"Polysole LS", trade mark, product of Showa Highpolymer Co., Ltd., Japan.
[3]Same as Sample 1 – 1.
[4]"Polysole EVA P-3", trade mark, product of Showa Highpolymer Co., Ltd., Japan.
[5]"JSR 0561", trade mark, product of Japan Synthetic Rubber Co., Ltd., Japan.
[6]"Acronal 230 D", trade mark, product of Yuka-Badische Co., Ltd., Japan.
[7]"JSR 0590", trade mark, product of Japan Synthetic Rubber Co., Ltd., Japan.
[8]"Neoprene 650", trade mark, product of Japan Neoprene Co., Ltd., Japan.

In the same manner as in Example 1, these four samples were tested for cleaning ability, with very satisfactory results that all the samples removed each stain readily. Especially, these samples adsorbed stencil ink much more quickly than the cleaning material prepared by impregnation with rubber latex only. Moreover, other surfaces were found free of staining when rubbed by the samples which had already adsorbed the ink thereon.

Further test was conducted on a coking agent 25 ("Home Coking", trade mark, product of Nippon Paint Co., Ltd., Japan) which remains unremoved with soap and water and which can not be removed completely even with organic solvents. About 200 mg of the coking agent was applied to the back of the hand over an area 1 cm by 3 cm and the resulting coating was rubbed by Sample 3 – 4 above which was wetted with warm water of about 40°C. The coating was completely wiped off with only two strokes of rubbing. This evidences the outstanding effect achieved by the use of latex mixture, in view of the fact that a cleaning material impregnated with rubber latex only required seven to eight strokes of rubbing to give the same result.

EXAMPLE 4

A piece of polyamide fiber nonwoven fabric ("Asahikasei Fushokufu N 20071", trade mark, product of Asahi Chemical Industry Co., Ltd., Japan), measuring 30 cm by 10 cm anad weighing 2.1 g was dipped in a mixture of styrene-butadidne rubber latex ("JSR 0561", trade mark, product of Japan Synthetic Rubber Co., Ltd., Japan, herein used as adjusted to a concentration of 25%) and polyvinyl acetate latex ("Polysole S - 5", trade mark, product of Showa Highpolymer Co., Ltd., Japan, herein used as adjusted to a concentration of 25%) and then dried to prepare a cleaning material. Similar samples of cleaning materials were prepared by varying the mixing ratio as listed in Table 4 below.

Table 4

| Sample No. | Mixing ratio in solid weight: Styrene-butadiene rubber latex | Mixing ratio in solid weight: Polyvinyl acetate latex | Amount of rubber in dried cleaning material |
|---|---|---|---|
| 4 – 1 | 7 | 3 | 0.95 g |
| 4 – 2 | 6 | 4 | " |
| 4 – 3 | 4 | 6 | " |
| 4 – 4 | 3 | 7 | " |
| 4 – 5 | 8 | 2 | " |
| Comprison | | | |

Table 4-continued

| Sample No. | Mixing ratio in solid weight: Styrene-butadiene rubber latex | Mixing ratio in solid weight: Polyvinyl acetate latex | Amount of rubber in dried cleaning material |
|---|---|---|---|
| A | 2 | 8 | " |

Note:
To prevent coagulation, 1 part of nonionic surface active agent was added to each of Samples 4 – 3, 4 – 4, 4 – 5 and Comparison A.

In the same manner as in Example 1, the samples thus prepared were tested for the ability to remove stencil ink. The ink was removed very satisfactorily by Samples 4 – 1, 4 – 2, 4 – 3 and 4 – 4 containing 30 to 70% of polyvinyl acetate in the latex mixture, whereas Sample 4 – 5 containing only 20% of polyvinyl acetate was somewhat inferior in the ink removing ability. Further Comparison Sample A containing only 20% of rubber could not remove the stencil ink completely.

In the same manner as in Example 3, the samples were tested in respect of the ability to remove coking agent, whereby the samples according to this invention were found very effective, in contrast with much lower ability of Comparison Sample A.

EXAMPLE 5

To 1 part of polyvinyl acetate latex ("Polysole S-5", trade mark, product of Showa Highpolymer Co., Ltd., Japan) were added 0.5 part of water and 0.1 part of polyoxyethylene sorbitan monolaurate ("Solgen TW 20", trade mark, product of Daiichi Kogyo Seiyaku Co., Ltd., Japan), and the mixture was throughly stirred. Subsequently, 1 part of styrene-butadiene rubber latex ("JSR-0561", trade mark, product of Japan Synthetic Rubber Co., Ltd., Japan) was added to the mixture, followed by stirring. 0.05 part of silicone oil ("Shin-etsu Silicone KF 96 – 1000 C.P.", trade mark, product of Shin-etsu Chemical Industry Co., Ltd., Japan) was further added to the resulting mixture, followed by stirring and then addition of 5 parts of water. Nonwoven fabric ("Bonnip V 1050", trade mark, product of Japan Nonwoven Fabric Co., Ltd., Japan) was dipped in the mixture thus prepared, then taken out therefrom with excess liquid mixture left dripping, and thereafter dried to obtain a cleaning material according to this invention, which contained about 30% of solids based on the weight of the nonwoven fabric.

The cleaning material obtained was wetted with water. The surfaces bearing stain or dirt and giving off disagreeable smells as given below were rubbed with the wet cleaning material with one to several strokes, whereby the dirt and smells were completely removed.

1. Sticky and stubborn dirt lodged on kitchen ventilator composed of oil and dust.
2. Cooking oil on gas range, column and wall.
3. Pomade and hand stain on glass.
4. Unpleasant smells of kerosene, garlic and fish on the hand and articles.
5. Hand stain on copying machine, calculator, office desk and like business machines.

EXAMPLE 6

A cleaning material was prepared according to this invention in the same manner as in Example 5 except that cotton woven fabric was used instead of nonwoven fabric.

An unsaturated polyester resin ("Polyset PS-595 AP-3", trade mark, product of Hitachi Kasei Co., Ltd., Japan) generally used as a material for adhesive was applied onto a steel plate over an area of 5 cm by 2 cm. Before the resin set, the coated surface was rubbed by the cleaning material which had previously been wetted with water, whereby the resin was readily removed. On the other hand, the same unsaturated polyester resin can not be removed completely with acetone in about 10 times as much time. Further, the cleaning material obtained in this example was found to be very effective in removing various coating compositions in unhardened state.

What is claimed is:

1. A method of cleaning a soiled surface comprising rubbing in the presence of water the surface to be cleaned with a fibrous cleaning material consisting essentially of a fibrous carrier which is impregnated with a mixture of (1) a latex of at least one rubber selected from the group consisting of natural rubber, butadiene rubber and styrene-butadiene rubber and (2) a polar high molecular weight substance selected from the group consisting of polyvinyl acetate, vinyl acetate-ethylene copolymer, acrylonitrile-butadiene copolymer, polychloroprene and acrylic resin and thereafter drying.

2. The method of cleaning a soiled surface according to claim 1, in which said rubber latex is natural rubber latex or styrene-butadiene rubber latex.

3. The method of cleaning soiled surface according to claim 1, in which said polar high molecular weight substance is at least one of polyvinyl acetate and vinylacetate-ethylene copolymer containing at least 80 wt.% of vinyl acetate.

4. The method of cleaning a soiled surface according to claim 1, in which said polyvinyl acetate has an average polymerization degree of 400 to 5,000 and said vinylacetate-ethylene copolymer has an average polymerization degree of 400 to 5,000.

5. The method of cleaning a soiled surface according to claim 1, in which the amount of the rubber contained in the fibrous carrier is in the range of 10 to 150 wt.%, based on the weight of the fibrous carrier.

6. The method of cleaning soiled surface according to claim 5, in which said amount of the rubber is in the range of 15 to 100 wt.%, based on the weight of the fibrous carrier.

7. The method of cleaning a soiled surface according to claim 1, in which the amount of said polar high molecular weight substance is up to 70 wt.%, based on the total weight of rubber and the polar high molecular weight substance.

8. The method of cleaning a soiled surface according to claim 7, in which said amount of polar high molecular weight substance is in the range of 30 to 60 wt.%, based on the total weight of rubber and the polar high molecular weight substance.

* * * * *